US006158672A

United States Patent [19]

Millan

[11] Patent Number: 6,158,672

[45] Date of Patent: Dec. 12, 2000

[54] SPRAY GUN ATOMIZING AIR BALANCE

[75] Inventor: Jorge Millan, Lawndale, Calif.

[73] Assignee: Northrop Grumman Corporation, Los Angeles, Calif.

[21] Appl. No.: 09/481,791

[22] Filed: Jan. 12, 2000

[51] Int. Cl.[7] ..... B05B 1/28

[52] U.S. Cl. ..... 239/290; 239/296; 239/427.3

[58] Field of Search ..... 239/290, 291, 239/296, 297, 311, 314, 418, 419, 419.3, 424, 424.5, 300, 427.3, 434, 432, 427, 475, 472, 490, 461–463, 468, 499, 600

[56] References Cited

U.S. PATENT DOCUMENTS

| | | | |
|---|---|---|---|
| 1,752,922 | 4/1930 | Mueller | 239/290 |
| 2,971,700 | 2/1961 | Peeps . | |
| 3,578,246 | 5/1971 | Davis et al. . | |
| 4,055,300 | 10/1977 | Binoche . | |
| 4,232,824 | 11/1980 | Binoche . | |
| 4,501,394 | 2/1985 | Kwok . | |
| 5,074,467 | 12/1991 | Geberth . | |
| 5,209,405 | 5/1993 | Robinson et al. | 239/296 |
| 5,344,078 | 9/1994 | Fritz et al. | 239/296 |
| 5,397,058 | 3/1995 | Zanetti | 239/290 |
| 5,639,024 | 6/1997 | Mueller . | |

FOREIGN PATENT DOCUMENTS

| | | | |
|---|---|---|---|
| 20384 | 8/1929 | Germany | 239/290 |

*Primary Examiner*—Andres Kashnikow
*Assistant Examiner*—Jorge Bocanegra
*Attorney, Agent, or Firm*—Terry J. Anderson; Karl J. Hoch, Jr.

[57] ABSTRACT

In accordance with the present invention, there is provided a balanced high volume, low pressure paint spray gun. The spray gun is provided with a spray gun body connectable to a paint source and an air source. The spray gun is provided with a head insert engaged with the spray gun body. The head insert has a paint atomization chamber formed therein, a paint passage formed therethrough extending into the paint atomization chamber for receiving paint from the paint source, an atomization air passage and a shaping air passage for receiving air flow from the air source therethrough, and a balancing air passage formed therein extending into the paint atomization chamber. The spray gun further has a shaping air chamber defined by the spray gun body. The shaping air chamber is disposed in fluid communication with the air source for receiving air flow therein, disposed in fluid communication with the shaping air passage for shaping spray patterns of atomized paint, and disposed in fluid communication with the balancing air passage. The paint atomization chamber defines a paint atomization zone, a paint spray pattern shaping zone, and an air pressure zone. The paint atomization zone is in fluid communication with the paint passage and the atomization air passage for discharging atomized paint therefrom. The paint spray pattern shaping zone is in fluid communication with the shaping air passage for shaping spray patterns of atomized paint. The air pressure zone is in fluid communication with the balancing air passage for regulating air pressure between the paint atomization chamber and the shaping air chamber.

21 Claims, 2 Drawing Sheets

SPRAY GUN ATOMIZING AIR BALANCE

BACKGROUND OF THE INVENTION

The present invention relates generally to paint spray guns, and more particularly to a high volume, low pressure spray gun having a controlled air cap pressure through a range of spray patterns.

In recent years, there has been an ever increasing industry and legislative drive towards increasing the transfer efficiency of fluid materials sprayed from pressurized spray guns. Transfer efficiency can be defined as the amount of sprayed fluid material, such as paint, that goes onto subject parts as compared to the amount lost to over spray and bounce back. A high transfer efficiency decreases fluid material consumption, reduces undesirable deposits on adjacent surfaces, and results in relatively less over spray which improves operator visibility. Importantly, transfer efficiency is a measure of the amount of fluid material dispersed into the ambient air which contributes to environmental pollution.

One class of spray gun uses pressurized air for atomizing liquid material and for shaping the envelope or pattern of the atomized liquid material as it is discharged from a nozzle assembly on the gun. Air atomization spray guns broadly fall into two classes. One type of air atomization spray gun uses a low volume flow of high pressure air (LVHP) for atomization and pattern shaping. The air pressure in such guns may typically be in the 40 psi to 100 psi range. The transfer efficiency associated with such guns, however, are far from optimal. This is due to the relatively high air pressures which produce a high degree of over spray and bounce back.

The other broad type of spray gun which uses pressurized air for atomizing liquid material employs a high volume, low pressure (HVLP) spray approach in order to increase fluid material transfer efficiency. The transfer efficiency of HVLP spray guns is much greater than the LVHP spray guns. HVLP atomization utilizes a high volume of air typically delivered at 10 psi or less to atomize fluid material. It is the large volume of air passing in contact with a fluid material in a suitable nozzle assembly which causes atomization of the fluid material.

Many industries have adopted the HVLP approach, either voluntarily or by legislative mandate. For example, currently the Southern California Air Quality Management District's rules and the EPA's National Emission Standards for Hazardous Air Pollutants require spray gun air cap pressure to be no greater than 10 psi.

One characteristic of HVLP spray guns is the variation in air cap pressure from full open spray pattern to closed spray pattern. Painters would prefer a consistent air cap pressure while adjusting the spray or fan pattern to stay in regulatory compliance so as to not exceed a 10 psi requirement, for example. By their design some spray guns vary 4 to 5 psi from full open spray pattern to fully closed. For example, if the spray gun is adjusted to provide an allowable 10 psi at a full open spray pattern and during the application the painter decides to close down the spray pattern, the air cap pressure may be increased to approximately 14 to 15 psi. Thus, the process would become out of regulatory compliance. If the painter attempts to compensate by adjusting the spray gun such that a full open spray pattern is achieved at 5 psi, then closing down the spray pattern during an application may result in an insufficient air cap pressure to atomize the paint for a quality finish.

It is therefore evident that there exists a need in the art for a high volume, low pressure spray gun which facilitates operation through a range to spray pattern adjustments while mitigating significant variations of the air cap pressure in comparison to the prior art devices.

BRIEF SUMMARY OF THE INVENTION

In accordance with the present invention, there is provided a balanced high volume, low pressure paint spray gun. The spray gun is provided with a spray gun body connectable to a paint source and an air source. The spray gun is provided with a head insert engaged with the spray gun body. The head insert has a paint atomization chamber formed therein, a paint passage formed therethrough extending into the paint atomization chamber for receiving paint from the paint source, an atomization air passage and a shaping air passage for receiving air flow from the air source therethrough, and a balancing air passage formed therein extending into the paint atomization chamber. The spray gun further has a shaping air chamber defined by the spray gun body. The shaping air chamber is disposed in fluid communication with the air source for receiving air flow therein, disposed in fluid communication with the shaping air passage for shaping spray patterns of atomized paint, and disposed in fluid communication with the balancing air passage. The paint atomization chamber defines a paint atomization zone, a paint spray pattern shaping zone, and an air pressure zone. The paint atomization zone is in fluid communication with the paint passage and the atomization air passage for discharging atomized paint therefrom. The paint spray pattern shaping zone is in fluid communication with the shaping air passage for shaping spray patterns of atomized paint. The air pressure zone is in fluid communication with the balancing air passage for regulating air pressure between the paint atomization chamber and the shaping air chamber.

In the preferred embodiment, the balancing air passage comprises a plurality of balancing air passages. The head insert has a head insert longitudinal axis disposed therethrough. The plurality of balancing air passages extend radially from the head insert longitudinal axis. The paint passage is disposed along the head insert longitudinal axis. The shaping air chamber may be disposed about the head insert longitudinal axis and is generally annular shaped. Further, the shaping air passage comprises a plurality of shaping air passages and the plurality of shaping air passages are generally parallel to the head insert longitudinal axis. In addition, the paint spray gun may be provided with a shaping air valve in fluid communication with the shaping air passage for selectively controlling airflow therethrough.

As such, based on the foregoing, the present invention mitigates the inefficiencies and limitations associated with prior art paint spray guns. The spray gun of the present invention is particularly adapted to comply with regulatory constraints. The spray gun is a high volume, low pressure device. In this regard, in the preferred embodiment of the present invention, the spray gun is provided with a head insert having balancing air passage. Advantageously, the balancing air passage connects the shaping air chamber with the paint atomization chamber. In this regard, variations in the air pressures between the shaping air chamber and the paint atomization chamber tend to be mitigated. In this respect, air flow may be diverted from the paint atomization chamber and therefore tending to lower the pressure therein. Thus, the air cap pressure tends to be less sensitive to changes in the air flow feeding into the shaping air chamber as paint spray patterns are adjusted.

Accordingly, the present invention represents a significant advance in the art.

BRIEF DESCRIPTION OF THE SEVERAL VIEWS OF THE DRAWING

These, as well as other features of the present invention, will become more apparent upon reference to the drawings wherein.

DETAILED DESCRIPTION OF THE INVENTION

Figure 1:
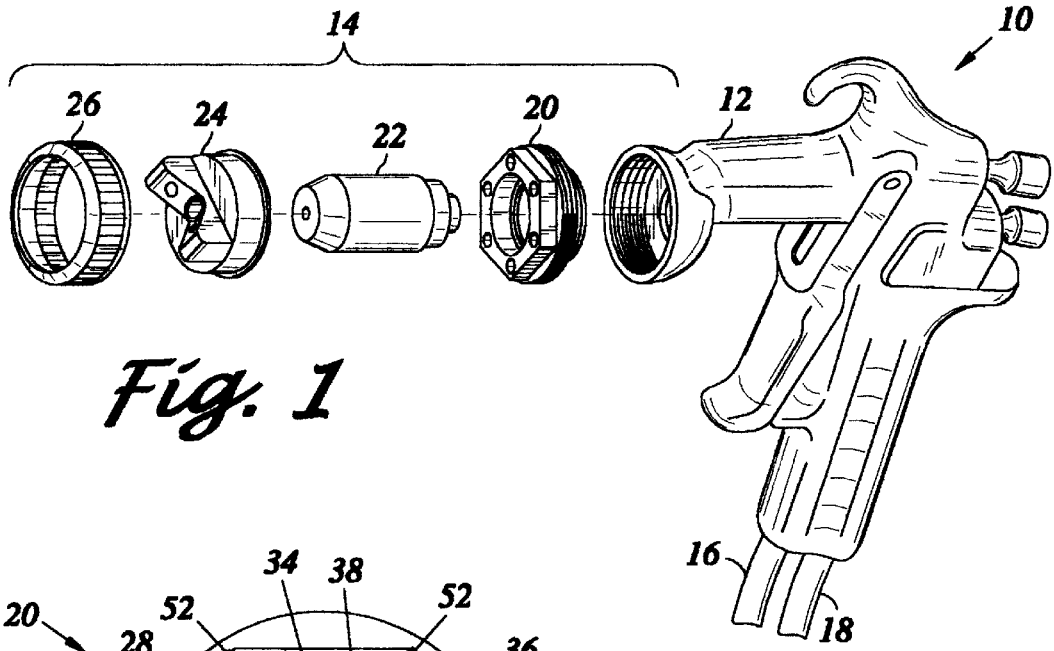
FIG. 1 is an exploded perspective view of the paint spray gun of the present invention, including a head insert.

Referring now to the drawings wherein the showings are for purposes of illustrating a preferred embodiment of the present invention only, and not for purposes of limiting the same, FIGS. 1–5 illustrate a high volume, low pressure paint spray gun which is constructed in accordance with the present invention.

Referring now to FIG. 1, in accordance with the present invention, there is provided a high volume, low pressure paint spray gun 10. The paint spray gun 10 is provided with a spray gun body 12 and a head assembly 14. The spray gun body 12 is connectable in fluid communication with a paint source 16 and an air source 18.

As used herein the terms 'paint' and 'paint source' shall refer to paint, coatings, primers, sealants, veneers, and similar fluid or liquid surface preparations. As is well known to one of ordinary skill in the art, though not depicted, it is contemplated that the spray gun body may be provided with a paint valve which is in fluid communication with the paint source 16 for selectively controlling paint flow. Further, as one of ordinary skill in the art can appreciate, the spray gun body 12 may be configured to divide pressurized air from the air source 18 into multiple airflows. In this regard, the spray gun body 12 is contemplated to include appropriate valving to effectuate the division of the air flow from the air source 18 into an atomizing air source 18*a* and a shaping air source 18*b* (as symbolically depicted in FIG. 5) which are selectively ported to the head assembly 14. The atomization air source 18*a* is used for atomizing paint and the shaping air source 18*b* is used for shaping paint spray patterns.

The spray gun 10 of the present invention is provided with a head insert 20. Further the spray gun 10 is preferably provided with a nozzle 22, an air cap 24 and a retaining ring 26. In general, as discussed more fully below, the head insert 20 is sized and configured to engage the spray gun body 12 to receive paint and airflow therethrough. The head insert 20 is further sized and configured to concentrically receive the nozzle 22 therethrough. The nozzle 22 is connectable to the spray gun body 12 in fluid communication with the paint source 16 discharging paint.

Figure 2:
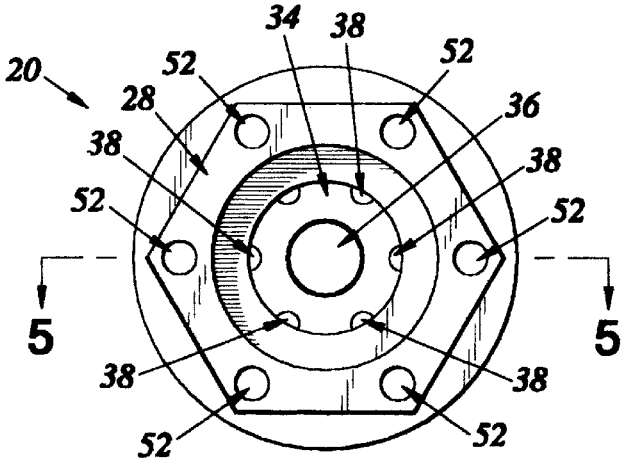
FIG. 2 is a top view of the head insert of FIG. 1.
Figure 3:
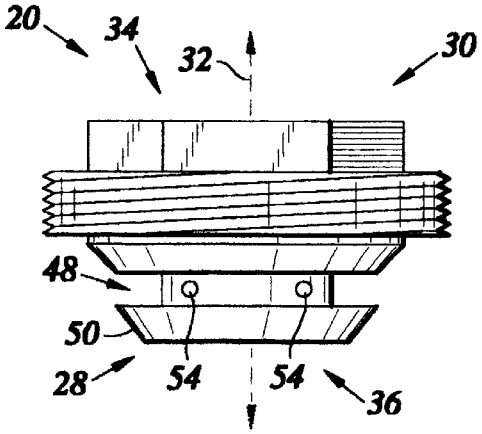
FIG. 3 is a side view of the head insert of FIG. 2.
Figure 4:
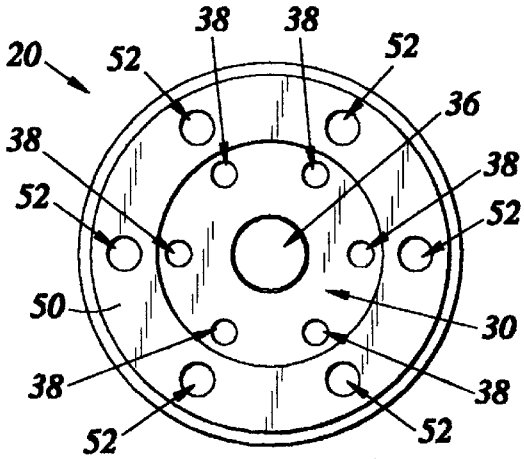
FIG. 4 is a bottom view of the head insert of FIG. 2.
Figure 5:
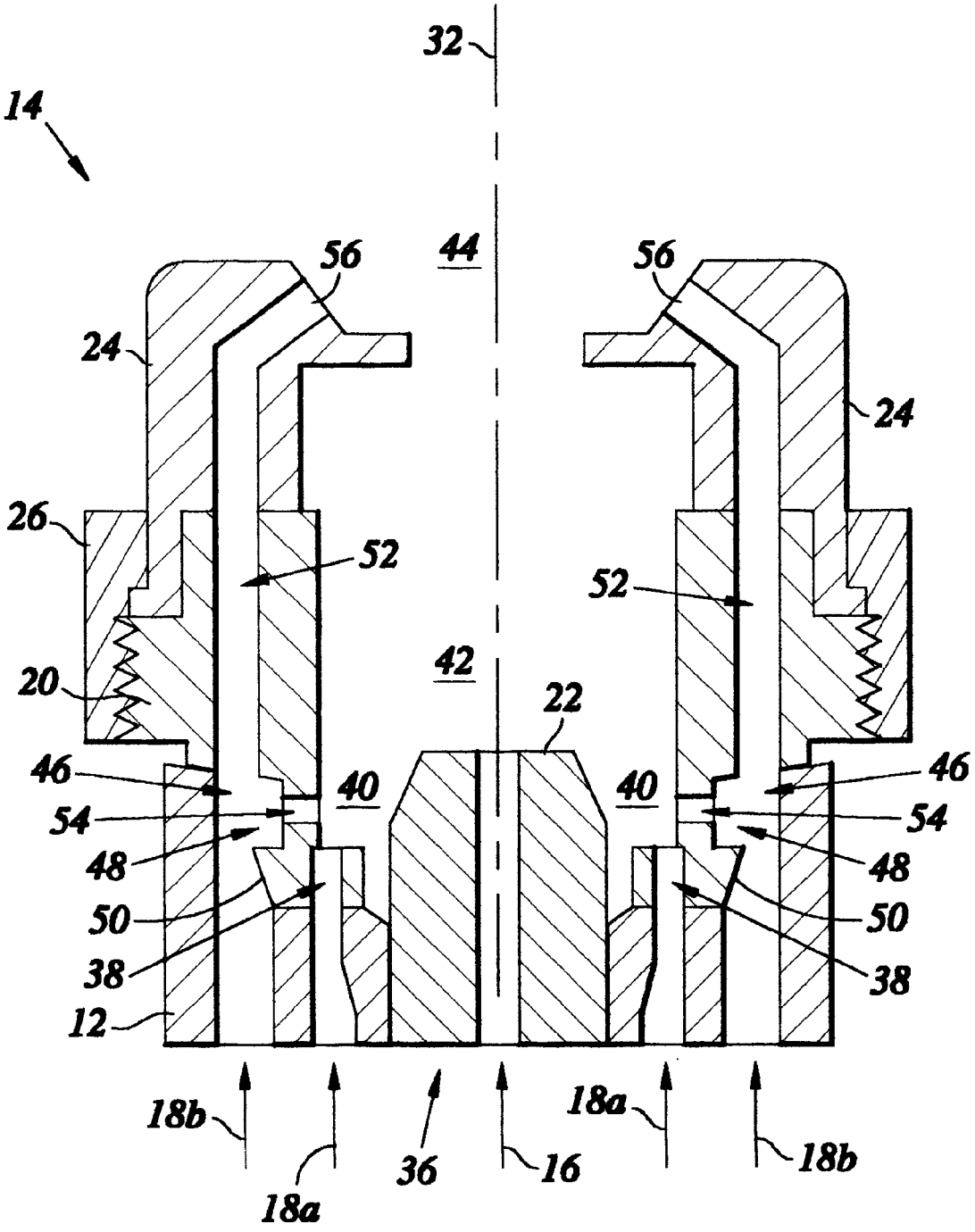
FIG. 5 is a cross-sectional view of the head insert seen along axis 5—5 of FIG. 2 with the head insert in its operable position with spray gun components as depicted in FIG. 1.

A head insert 20 is formed to be engagable with the spray gun body 12. In the preferred embodiment, the head insert 20 is formed to have first and second ends 28, 30, and a head insert longitudinal axis 32 extending therethrough. FIG. 2 depicts an end view of the second end 30 of the head insert 20. Similarly, FIG. 4 depicts an end view of the first end 28 of the head insert 20. FIG. 3 is a side view of the head insert 20 with the first and second ends 28, 30 as being respectively disposed at the bottom and top of the head insert 20. As shown in FIG. 5, the first end 28 is sized and configured to engage the spray gun body 12. It is contemplated that intermediate couplings or adaptors may be inserted between the spray gun body 12 and the head insert 20 to facilitate the engagement thereof.

The head insert 20 is formed to have a paint atomization chamber 34 formed therein. Preferably, the paint atomization chamber 34 extends along the head insert longitudinal axis 32 into the head insert 20 from the second end 30 towards the first end 28. As such, the paint atomization chamber 34 is formed to be partially open. In addition, a paint passage 36 extends along the head insert longitudinal axis 32 into the head insert 20 from the first end 28 and opens into the paint atomization chamber 34. The paint passage 36 is sized and configured to receive paint therethrough from the paint source 16 via the spray gun body 12. In this regard, the nozzle 22 is sized and configured to be inserted within the paint passage 36 to receive paint therethrough from the paint source 16 via the spray gun body 12.

The head insert 20 is preferably provided with a plurality of atomization air passages 38. In the preferred embodiment, the atomization air passages 38 extend through the head insert 20 parallel to the head insert longitudinal axis 32. The atomization air passages 38 are sized and configured to engage the spray gun body 12 to receive air flow from the atomizing air source 18*a*. In this regard, FIG. 5 depicts the head insert 20 in its operable position as engaged with the spray gun body 12. As can be seen, the atomization air passages 38 open into the paint atomization chamber 34. The atomization air passages 38 are preferably distributed circumferentially about the paint passage 36. As is further discussed in detail below, the paint atomization chamber 34 defines an air pressure zone 40, a paint atomization zone 42 and a paint spray pattern shaping zone 44. The air pressure zone 40 is generally defined as that region adjacent the atomization air passages 38 within the paint atomization chamber 34.

A shaping air chamber 46 is cooperatively defined by the spray gun body 12 and the head insert 20. In this regard, the head insert 20 has an outer indenture 48 formed therein. The outer indenture 48 is adjacent the first end of the head insert 20. Preferably, the outer indenture 48 is generally annular shaped. The shaping air chamber 46 is sized and configured to be disposed in fluid communication with the shaping air source 18*b*. The head insert may be provided with an annular lip 50 which partially defines the outer indenture 48. The annular lip 50 may be sized and configured to engage the spray gun body 12.

The head insert 20 is provided with a plurality of shaping air passages 52 which extend therethrough. In the preferred embodiment, the shaping air passages 52 extend through the head insert 20 parallel to the head insert longitudinal axis 32. The shaping air passages 52 are sized and configured to open into the shaping air chamber 46. The shaping air passages 52 are preferably distributed circumferentially about the paint passage 36 and the atomization air passages 38.

Importantly, the head insert 20 is preferably provided with a plurality of balancing air passages 54. The balancing air passages 54 may be aligned radially from the head insert longitudinal axis 32. The balancing air passages 54 extend from the paint atomization chamber 34, and in particular to the air pressure zone 40 thereof, to the shaping air chamber 46 for regulating air pressure between the paint atomization chamber 34 and the shaping air chamber 46. In this regard, the balancing air passages 54 are disposed in fluid communication with both paint atomization chamber 34 and the shaping air chamber 46.

As mentioned above, a paint atomization zone 42 is defined by the paint atomization chamber 34. The paint atomization zone 42 is generally defined at that region where paint discharged through the paint passage 36 and air flow discharged from the atomization air passages 38 interact to produce atomized paint. In this regard, the paint atomization zone 42 is disposed adjacent to and may overlap with the air pressure zone 40. As such, the paint atomization zone 42 is disposed in fluid communication with the paint passage 36 and the atomization air passages 38 for discharging atomized paint therefrom.

As further mentioned above, a paint spray pattern shaping zone 44 is defined by the paint atomization chamber 34. The paint spray pattern shaping zone 44 is generally defined as that region where the atomized paint and air flow from the shaping air passages 52 interact shaping spray patterns of atomized paint. As such, the paint atomization zone 42 is disposed in fluid communication with the paint passage 36 and the atomization air passages 38 for discharging atomized paint therefrom. In this regard, the paint spray pattern shaping zone 44 is disposed adjacent to and may overlap with the paint atomization zone 42.

In the preferred embodiment, the air cap 24 is sized and configured to engage the head insert 20 in fluid communication with the shaping air passages 52 for shaping spray patterns of the atomized paint. The air cap 24 is provided with a pair of shaping air horns 56 which allow fluid communication with the shaping air passages 52 for discharging air flow into the spray pattern shaping zone 44. Further, though not shown, the spray gun 10 may be provided with a pressure gauge for monitoring the air pressure adjacent the head insert 20.

In practice, it is contemplated that paint from the paint source 16 flows through spray gun body 12 and into the nozzle 22 which resides within the paint passage 36 of the head insert 20. Paint is then discharged into the paint atomization chamber 34 along with air flow from the atomization air passages 38. The particular sizing and configuration of the atomization air passages 38 and the air flow pressures are chosen from those values which are well known to one of ordinary skill in the art for sufficient paint atomization. Once the paint is atomized, the atomized paint encounters air flow discharged from the shaping air passages 52 into the shaping air zone 24. As one of ordinary skill in the art can appreciate, the paint spray patterns may be influenced by adjusting the pressure of the air flow passing through the shaping air passages 52.

Advantageously, the balancing air passages 54 connect the shaping air chamber 46 with the paint atomization chamber 34. In this regard, variations in the relative air pressures between the shaping air chamber 46 and the paint atomization chamber 34 tend to be mitigated. It is contemplated that where the pressure within the air pressure zone 42 is greater than that within the shaping air chamber 46 air flow is diverted from the paint atomization chamber 34 into the shaping air chamber 46. As such, this siphoning of the air flow into the shaping air chamber 46 tends to make the air cap pressure or that overall air pressure at or adjacent to the spray pattern shaping zone 44 less sensitive to variations of the air pressure of air flow entering into the shaping air chamber 46 from the shaping air source 18*b*. This is because the air cap pressure or that overall air pressure at or adjacent to the spray pattern shaping zone 44 is a function of the air pressure within the paint atomization chamber 34. Thus, the air cap pressure tends to be less sensitive to changes in the air flow feeding into the shaping air chamber 34 as paint spray patterns are adjusted.

A test was performed utilizing a Binks Mach 1 HVLP spray gun which included a head insert part #54-3543. The test data was developed using the spray gun as provided by the manufacturer and as modified. The modification was effected by the introduction of six 0.0469 diameter holes though the head insert part in manner and configuration as depicted as the balancing air passages 52 as shown in FIGS. 3 and 5. A regulator air pressure of 78 psi was established with the spray gun. With the shaping air flow feeding into the shaping air chamber from the air source fully open or unrestricted, the air cap pressure was measured for each spray gun. The spray gun as provided from the manufacturer was measured to have an air cap pressure of approximately 17.5 psi. In contrast, the modified spray gun was measured to have an air cap pressure of approximately 10 psi. With the shaping air flow feeding into the shaping air chamber from the air source fully closed or completely restricted, the air cap pressure was measure for each spray gun. The spray gun as provided from the manufacturer was measured to have an air cap pressure of approximately 11.5 psi. In contrast, the modified spray gun was measured to have an air cap pressure of approximately 9 psi. As such, it is observed that the effect of the introduction of the six 0.0469 diameter holes though the head insert part in manner and configuration as depicted as the balancing air passages 52 as shown in FIGS. 3 and 5 was to effect a balancing or regulation of the relative air pressure between restricted and unrestricted configurations of the shaping air flow for adjusting paint spray patterns.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A balanced high volume, low pressure paint spray gun comprising:

a spray gun body connectable to a paint source and an air source;

a head insert engaged with the spray gun body, the head insert having a paint atomization chamber formed therein, a paint passage formed therethrough extending into the paint atomization chamber for receiving paint from the paint source, an atomization air passage and a shaping air passage for receiving air flow from the air source therethrough, and a balancing air passage formed therein extending into the paint atomization chamber; and a shaping air chamber defined by the spray gun body, disposed in fluid communication with the air source for receiving air flow therein, disposed in fluid communication with the shaping air passage for shaping spray patterns of atomized paint, disposed in fluid communication with the balancing air passage;

wherein the paint atomization chamber defining a paint atomization zone, a paint spray pattern shaping zone, and an air pressure zone, the paint atomization zone being in fluid communication with the paint passage and the atomization air passage for discharging atomized paint therefrom, the paint spray pattern shaping zone being in fluid communication with the shaping air passage for shaping spray patterns of atomized paint, the air pressure zone being in fluid communication with the balancing air passage for regulating air pressure between the paint atomization chamber and the shaping air chamber.

2. The paint spray gun of claim 1 wherein the head insert has first and second ends.

3. The paint spray gun of claim 2 wherein the first end is sized and configured to engage the spray gun body.

4. The paint spray gun of claim 2 wherein the paint atomization chamber extends into the head insert from the second end towards the first end.

5. The paint spray gun of claim 2 wherein the paint passage extends into the head insert from the first end and opens into the paint atomization chamber.

6. The paint spray gun of claim 1 wherein the head insert has an outer indenture formed therein.

7. The paint spray gun of claim 6 wherein the outer indenture is adjacent the first end of the head insert.

8. The paint spray gun of claim 6 wherein the outer indenture is generally annular shaped.

9. The paint spray gun of claim 6 wherein the outer indenture partially defines the shaping air chamber.

10. The paint spray gun of claim 1 wherein the balancing air passage comprises a plurality of balancing air passages.

11. The paint spray gun of claim 10 wherein the head insert is defined by a head insert longitudinal axis disposed therethrough.

12. The paint spray gun of claim 11 wherein the plurality of balancing air passages extend radially from the head insert longitudinal axis.

13. The paint spray gun of claim 1 wherein the head insert has a head insert longitudinal axis disposed therethrough.

14. The paint spray gun of claim 13 wherein the paint passage is disposed along the head insert longitudinal axis.

15. The paint spray gun of claim 13 wherein the paint atomization chamber is disposed along the head insert longitudinal axis.

16. The paint spray gun of claim 13 wherein the shaping air chamber is disposed about the head insert longitudinal axis and is generally annular shaped.

17. The paint spray gun of claim 1 wherein the shaping air passage comprises a plurality of shaping air passages.

18. The paint spray gun of claim 17 wherein the head insert has a head insert longitudinal axis disposed therethrough, the plurality of shaping air passages are generally parallel to the head insert longitudinal axis.

19. The paint spray gun of claim 1 further comprising a nozzle sized and configured to be concentrically received through the paint passage for discharging paint from the paint source therethrough.

20. The paint spray gun of claim 1 further comprising an air cap sized and configured to engage the head insert in fluid communication with the shaping air passage for shaping spray patterns of atomized paint.

21. A head assembly for use with a high volume, low pressure paint spray gun, the paint spray gun having a spray gun body connectable to a paint source and an air source, the head assembly comprising:

a head insert engaged with the spray gun body, the head insert having a paint atomization chamber formed therein, a paint passage formed therethrough extending into the paint atomization chamber for receiving paint from the paint source, an atomization air passage and a shaping air passage for receiving air flow from the air source therethrough, and a balancing air passage formed therein extending into the paint atomization chamber; and a shaping air chamber defined by the spray gun body, disposed in fluid communication with the air source for receiving air flow therein, disposed in fluid communication with the shaping air passage for shaping spray patterns of atomized paint, disposed in fluid communication with the balancing air passage;

wherein the paint atomization chamber defining a paint atomization zone, a paint spray pattern shaping zone, and an air pressure zone, the paint atomization zone being in fluid communication with the paint passage and the atomization air passage for discharging atomized paint therefrom, the paint spray pattern shaping zone being in fluid communication with the shaping air passage for shaping spray patterns of atomized paint, the air pressure zone being in fluid communication with the balancing air passage for regulating air pressure between the paint atomization chamber and the shaping air chamber.

* * * * *